US008689552B2

(12) United States Patent
Iwata

(10) Patent No.: US 8,689,552 B2
(45) Date of Patent: Apr. 8, 2014

(54) CENTRIFUGAL COMPRESSOR AND TURBOCHARGER

(75) Inventor: Akitoshi Iwata, Susono (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 0 days.

(21) Appl. No.: 13/508,085

(22) PCT Filed: Nov. 17, 2009

(86) PCT No.: PCT/JP2009/069507

§ 371 (c)(1),
(2), (4) Date: May 4, 2012

(87) PCT Pub. No.: WO2011/061816

PCT Pub. Date: May 26, 2011

(65) Prior Publication Data

US 2012/0230817 A1 Sep. 13, 2012

(51) Int. Cl.
*F02B 33/44* (2006.01)
*F01B 25/00* (2006.01)

(52) U.S. Cl.
USPC ..... 60/605.1; 415/26; 415/48

(58) Field of Classification Search
USPC ..... 60/605.1; 415/26, 36, 42, 48, 49, 150, 415/156, 157–158, 159, 165
See application file for complete search history.

(56) References Cited

U.S. PATENT DOCUMENTS 3,478,955 A * 11/1969 Kunderman ..... 415/158
3,784,318 A * 1/1974 Davis ..... 415/158
4,470,256 A * 9/1984 Palmer ..... 415/150
4,932,835 A * 6/1990 Sorokes ..... 415/150
4,969,798 A * 11/1990 Sakai et al. ..... 415/157
2008/0138200 A1 6/2008 Umeyama et al.

FOREIGN PATENT DOCUMENTS

| | | | |
|---|---|---|---|
| FR | 1142403 | A | 9/1957 |
| GB | 753316 | A | 7/1956 |
| JP | 45-38087 | B2 | 12/1970 |
| JP | 58-122400 | A | 7/1983 |
| JP | 58-124099 | A | 7/1983 |
| JP | 62-135899 | A | 8/1987 |
| JP | 08-144999 | A | 6/1996 |
| JP | 09-100799 | A | 4/1997 |

(Continued)

OTHER PUBLICATIONS

Machine translation of JP 2001-329996 A (published Nov. 30, 2001) attached.*

(Continued)

*Primary Examiner* — Thomas Denion
*Assistant Examiner* — Ngoc T Nguyen
(74) *Attorney, Agent, or Firm* — Kenyon & Kenyon LLP

(57) ABSTRACT

A centrifugal compressor is provided with: a housing which houses a compressor wheel therein; a spiral scroll arranged in an outer periphery of the compressor wheel; and a diffuser portion provided as a path space communicating with the scroll from an outlet side of the compressor wheel and formed by a compressor housing and a center housing. The centrifugal compressor is also provided with a movable vane which is movable between a projecting position where the movable vane projects from the compressor housing and a housing position where the movable vane houses in a housing portion provided in compressor housing, and an actuator which drives the movable vane between the projecting position and the housing position. The actuator is provided in the center housing.

5 Claims, 8 Drawing Sheets

(56) References Cited

FOREIGN PATENT DOCUMENTS

| | | | | |
|---|---|---|---|---|
| JP | 2001-329996 | A | | 11/2001 |
| JP | 2004-211608 | A | | 7/2004 |
| JP | 2008-144615 | A | | 6/2008 |
| SU | 1134753 | A | * | 1/1985 |

OTHER PUBLICATIONS

Machine translation of JP 2001-329995 A (published Nov. 30, 2001) attached.*

Japanese Patent Office, International Search Report in International application No. PCT/JP2009/069507, dated Feb. 16, 2010.

* cited by examiner

CENTRIFUGAL COMPRESSOR AND TURBOCHARGER

This is a 371 national phase application of PCT/JP2009/069507 filed 17 Nov. 2009, the content of which is incorporated herein by reference.

TECHNICAL FIELD

The present invention relates to a centrifugal compressor provided with a movable vane moving in and out of a diffuser portion, and a turbocharger having the centrifugal compressor.

BACKGROUND ART

There is known a centrifugal compressor in which a movable vane movable between a projecting position where it is projected into a diffuser portion and a housing position where it is housed in a housing chamber provided in a diffuser wall is provided in the diffuser portion. For example, there is known a centrifugal compressor in which the inside of the housing chamber is divided into two spaces by a partition member equipped with the movable vane and the partition member is moved by a pressure difference between the two spaces and a spring provided in one space so as to house the movable vane in the other space or to project the movable vane toward the diffuser portion (see Patent Literature 1).

CITATION LIST

Patent Literature

Patent Literature 1: JP-A-2001-329996

SUMMARY OF INVENTION

Technical Problem

In the centrifugal compressor of Patent Literature 1, the housing chamber housing the movable vane and a driving mechanism driving the movable vane are provided in the same diffuser wall. Thereby, there is a possibility that one side provided with the diffuser wall may be lengthened in a direction of a rotational axis of a compressor wheel compared to the other side with the diffuser portion interposed therebetween. Further, in the centrifugal compressor, since the movable vane is housed in the housing chamber and also the driving mechanism is housed thereto, the housing chamber needs to be increased in size as much as the volume of the movable vane and the driving mechanism. Thereby, there is a possibility that a housing may be increased in size.

In view of the foregoing, an object of the present invention is to provide a centrifugal compressor and a turbocharger which is advantageous to downsizing compared to that of the related art.

Solution to Problem

A centrifugal compressor of the present invention comprises: a housing which houses a compressor wheel therein and supports the compressor wheel so as to be rotatable about an axis; a spiral scroll which is provided in the housing so as to be arranged in an outer periphery of the compressor wheel; and a diffuser portion which is provided as a path space communicating with the scroll from an outlet side of the compressor wheel and is formed by a pair of wall portions facing each other, wherein the centrifugal compressor further comprises: a movable vane which is movable between a projecting position where the movable vane projects so as to cross the diffuser portion from one wall portion of the pair of wall portions and a housing position where the movable vane retracts toward the one wall portion from the projecting position so as to be housed in a housing portion provided in the one wall portion; and a driving device which drives the movable vane between the projecting position and the housing position, and the driving device is provided in the other wall portion of the pair of wall portions.

According to the centrifugal compressor of the present invention, since the one wall portion is provided with the housing portion and the other wall portion is provided with the driving device, it is possible to prevent only one of the one wall portion and the other wall portion from being lengthened in the axial direction. Further, since the volume of the housing portion may be slightly larger than the volume of the movable vane, it is possible to prevent increasing in size of the housing portion too much without any purpose. Accordingly, since it is possible to suppress increasing in size of the housing, it is possible to downsizing of the centrifugal compressor compared to that of the related art.

In one embodiment of the centrifugal compressor of the present invention, the driving device may include an operation chamber which is provided in the other wall portion, a partition member which is movable inside the operation chamber in a reciprocating manner so as to divide the inside of the operation chamber into a first chamber provided on a diffuser portion side and a second chamber provided on an anti-diffuser portion side opposite side of the diffuser portion side, a connection member which connects the partition member and the movable vane to each other so as to be operated as one unit through a penetration hole provided in the other wall portion, a spring device which presses at least either one of the movable vane and the partition member toward either one side of the diffuser portion side or the anti-diffuser portion side so that the partition member moves toward the one side, and a pressure control device which is capable of controlling a difference between a pressure of the first chamber and a pressure of the second chamber so that the partition member moves toward the other side of the diffuser portion side or the anti-diffuser portion side against the spring device.

When the movable vane is housed in the operation chamber, the wall portion separating the operation chamber and the diffuser portion from each other needs to be provided with a penetration hole through which the movable vane is able to pass. In this case, since a gap which has almost the same length as that of the outer periphery of the movable vane is formed between the movable vane and the wall portion, foreign matter such as dust may easily enter the operation chamber from the diffuser portion. On the other hand, in this embodiment of the present invention, the other wall portion may be provided with the penetration hole through which the connection member passes. Then, since the cross-sectional area of the connection member may be smaller than that of the movable vane, it is possible to decrease the size of the penetration hole to be provided in the other wall portion. In this case, since the gap between the connection member and the other wall portion can be formed small, it is possible to suppress foreign matter from intruding into the operation chamber. Thereby, it is possible to suppress an abnormality that the partition member is immovable. Further, since the volume of the operation chamber may be smaller than that of the centrifugal compressor housing the movable vane to the inside of the operation chamber, the housing may be further suppressed from being increased in size. Thereby, it is possible to downsizing the centrifugal compressor further.

In this embodiment, the other wall portion may be provided with a partition wall member which includes the penetration hole and is arranged between the diffuser portion and the operation chamber so as to separate the operation chamber and the diffuser portion from each other. In this case, since the partition wall member can be separated from the other wall portion, a component such as the partition member can be easily inserted into the operation chamber. Thereby, the centrifugal compressor can be easily assembled and the working efficiency can be improved.

Further, the movable vane may come into contact with the partition wall member at the projecting position, and at least a portion in the partition wall member which comes into contact with the movable vane may be formed of an elastic material. In this case, it is possible to prevent abnormal noise from being generated even when the movable vane and the partition wall member come into contact with each other. Further, even when the movable vane and the partition wall member come into contact with each other, it is possible to prevent the movable vane from being abraded and broken. Furthermore, by contacting the movable vane and the partition wall member with each other, it is possible to eliminate a gap between the other wall portion and the movable vane at the projecting position. In this case, since a gas which is ejected from the compressor wheel can be reliably guided between the movable vanes, it is possible to improve the efficiency of the centrifugal compressor when the movable vane moves to the projecting position. Further, when the movable vane and the other wall portion come into contact with each other at the projecting position in this way, it is possible to prevent a variation in the position of the movable vane at the projecting position for each product. Thereby, it is possible to suppress a variation in the performance for each product.

In one embodiment of the centrifugal compressor of the present invention, the movable vane may be provided with a shaft member which extends from the movable vane toward the one wall portion so as to be parallel to a movement direction of the movable vane, and the one wall portion may be provided with a support hole which supports the shaft member in a slidable manner. In this case, since the movable vane is supported by both the other wall portion and the one wall portion, a friction between the connection member and the other wall portion can be reduced. Accordingly, since a driving force necessary for driving the movable vane can be reduced, it is possible to downsizing downsize the driving device. Further, it is possible to suppress an abrasion of the connection member and the other wall portion by reducing the friction between the connection member and the other wall portion.

In one embodiment of the centrifugal compressor of the present invention, the spring device may be provided in the other wall portion. In this case, the operation chamber can be further decreased in size. Thereby, it is possible to downsize the centrifugal compressor further.

The driving device which is provided in the centrifugal compressor of the present invention may drive the movable vane between the projecting position and the housing position. For example, the driving device may include an electric motor and a cam mechanism which converts a rotary motion of an output shaft of the electric motor into a linear motion so that the movable vane is driven between the projecting position and the housing position. Further, the driving device may include a position switching member which has an inclined surface extending in a direction inclined with respect to a movement direction of the movable vane, and in which a transmitting member extending from the movable vane is provided so as to come into contact with the inclined surface, and an electric motor which drives the position switching member so that the inclined surface moves in a direction perpendicular to the movement direction of the movable vane. In this way, the movable vane may be driven by the electric motor.

The turbocharger of the present invention comprises the above-described centrifugal compressor and a turbine, wherein the centrifugal compressor is provided to an intake passage of an internal combustion engine and the turbine is provided to an exhaust passage of the internal combustion engine, and the turbine recovers exhaust energy of the internal combustion engine, and the turbocharger supercharges the internal combustion engine by driving to rotate the compressor wheel of the centrifugal compressor by the exhaust energy recovered.

According to the turbocharger of the present invention, with the above-described centrifugal compressor, the housing of the centrifugal compressor can be prevented from being increased in size. Thereby, it is possible to downsizing the turbocharger compared to that of the related art.

DESCRIPTION OF EMBODIMENTS

First Embodiment

Figure 1:
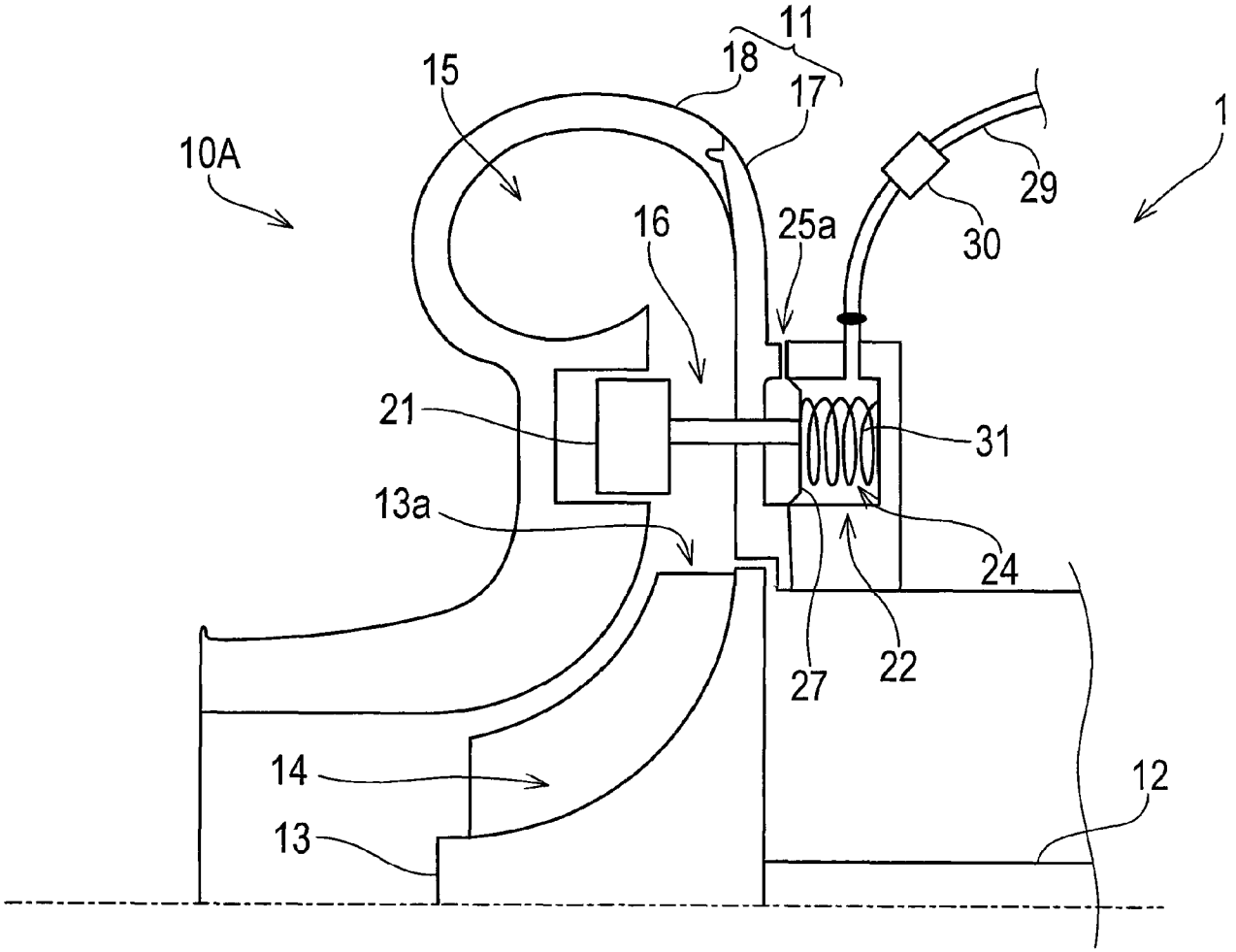
FIG. 1 is a view showing a turbocharger which includes a centrifugal compressor according to a first embodiment of the present invention.

FIG. 1 shows a turbocharger which includes a centrifugal compressor according to a first embodiment of the present invention. In this figure, a part of the cross-section of the centrifugal compressor is shown. The turbocharger 1 is used to supercharge an internal combustion engine which is mounted on a vehicle. The turbocharger 1 includes a turbine (not shown) which is provided to an exhaust passage of the internal combustion engine and a centrifugal compressor (hereinafter, also referred to as a compressor) 10A which is provided to an intake passage of the internal combustion engine. The turbocharger 1 is configured to recover exhaust energy of the internal combustion engine using the turbine and to drive the compressor 10A using the exhaust energy recovered.

As shown in this figure, the compressor 10A includes a housing 11 and a compressor wheel 13 which is housed in the housing 11 and is supported by a rotary shaft 12 so as to be rotatable about the axis Ax. The housing 11 includes a wheel chamber 14 which houses the compressor wheel 13, a spiral scroll 15 which is provided in an outer periphery of the wheel chamber 14, and a diffuser portion 16 which is provided as a path space communicating with the scroll 15 from an outlet side 13*a* of the compressor wheel 13. The compressor wheel 13 is connected to a turbine wheel of the turbine (both are not shown in the figure) through the rotary shaft 12 so as to rotate as one unit. The housing 11 includes a center housing 17 which supports the rotary shaft 12 so as to be rotatable, and a compressor housing 18 which is attached to the center housing 17 to form the wheel chamber 14, the diffuser portion 16, and the scroll 15. Since these components may be the same as those of the compressor of the known turbocharger, the detailed description thereof will be omitted.

The compressor 10A is provided with a movable vane mechanism 20. The movable vane mechanism 20 includes plural movable vanes 21 (in FIG. 1, only one of them is shown) and an actuator 22 as a driving device which drives each of the movable vanes 21. Each movable vane 21 is movable in a direction of the axis Ax between a projecting position P1 where the movable vane projects from the compressor housing 18 so as to cross the diffuser portion 16 and a housing position P2 where the movable vane is housed in a housing portion 23 provided in the compressor housing 18. Further, the plural movable vanes 21 are arranged at the same interval about the axis Ax in the diffuser portion 16 at the projecting position P1. The housing portion 23 is provided in the compressor housing 18 so as to be hollowed in the axial direction from a wall surface 18*a* which forms the diffuser portion 16. As shown in this figure, the diffuser portion 16 is formed by the compressor housing 18 and the center housing 17. Further, the housing portion 23 is provided in the compressor housing 18, and the actuator 22 is provided in the center housing 17. Thereby, the compressor housing 18 corresponds to one wall portion of the present invention, and the center housing 17 corresponds to the other wall portion of the present invention.

Figure 2:
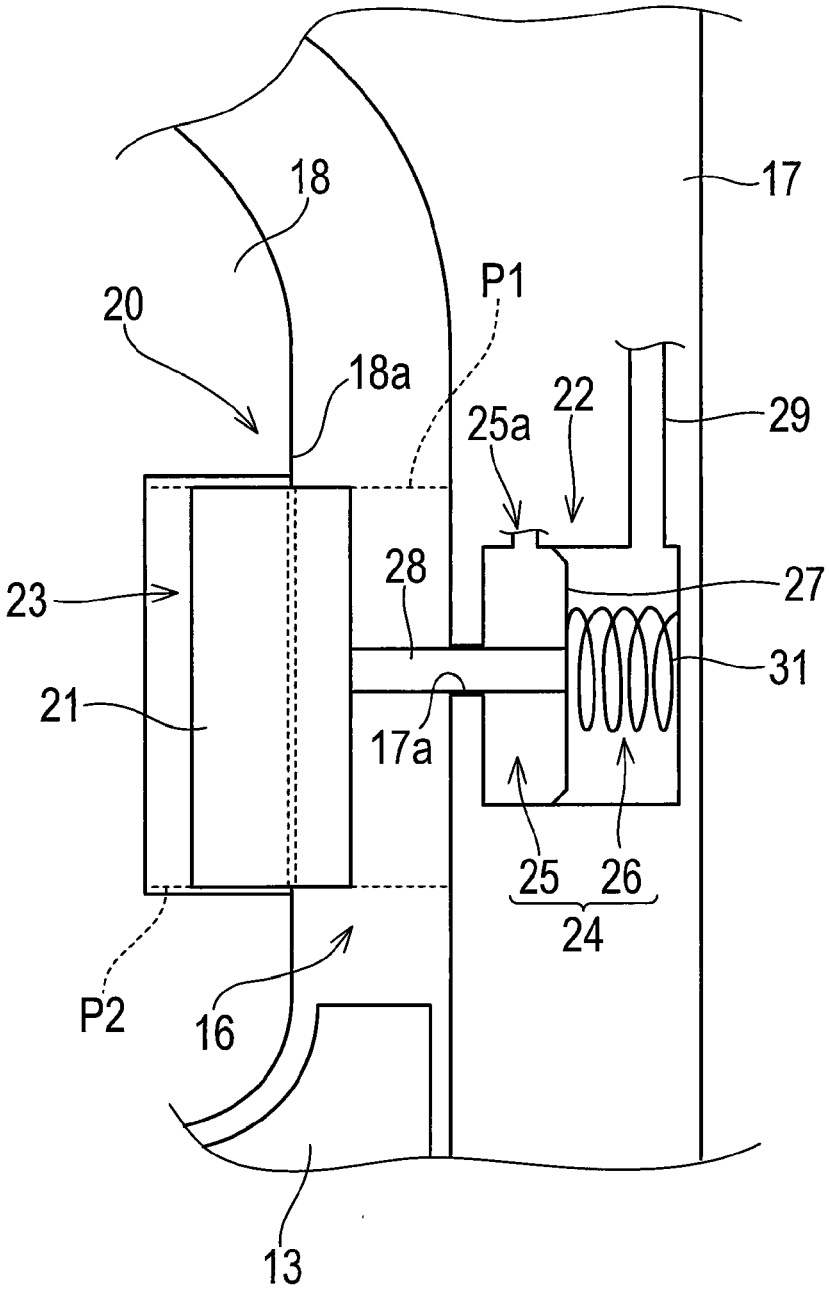
FIG. 2 is an enlarged view showing a movable vane mechanism of FIG. 1.
Figure 3A:
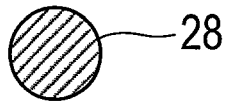
FIG. 3A is a view showing an example of a cross-section of a connection member of FIG. 1.
Figure 3B:
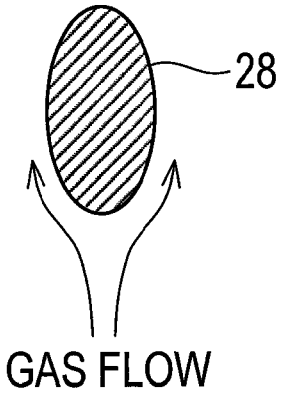
FIG. 3B is a view showing another example of a cross-section of the connection member of FIG. 1.
Figure 4:
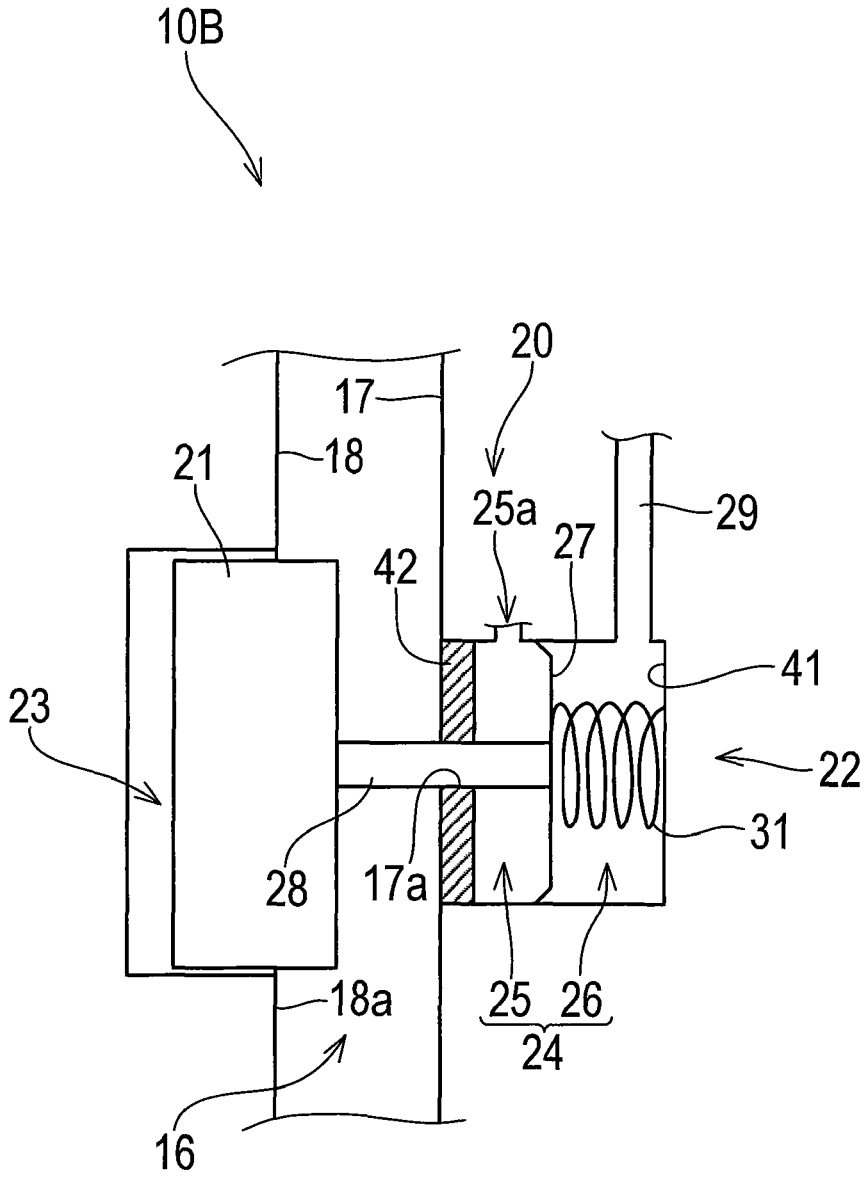
FIG. 4 is a view showing a centrifugal compressor according to a second embodiment of the present invention.

As shown enlarged in FIG. 2, the actuator 22 includes an operation chamber 24 which is provided inside the center housing 17. The operation chamber 24 is formed throughout the entire circumference about the axis Ax. The operation chamber 24 is provided with a partition member 27 which is movable inside the operation chamber 24 in the direction of the axis Ax in a reciprocating manner so as to divide the inside into a first chamber 25 and a second chamber 26. The partition member 27 and the movable vane 21 are connected to each other by a connection member 28 so as to be operated as one unit. As shown in this figure, the connection member 28 connects the partition member 27 and the movable vane 21 to each other through a penetration hole 17*a* which is provided in the center housing 17. The cross-section of the connection member 28 may be circular as shown in FIG. 3A, and may be an airfoil shape shown in FIG. 3B. In the case of the airfoil shape, the connection member 28 is arranged so as not to disturb the flow of a gas of the diffuser portion 16 such that one end arranged at the upstream side of the flow faces the compressor wheel 13 and the other end faces the scroll 15. The penetration hole 17*a* is formed in a shape in which the cross-sectional area thereof is equal to the cross-sectional area of the connection member 28. As shown in this figure, the first chamber 25 is provided on a diffuser portion side (on the left side in the figure) where the diffuser portion 16 is present, and the second chamber 26 is provided on an anti-diffuser portion side (on the right side in the figure) opposite side of the diffuser portion side. The first chamber 25 is opened to atmosphere through an opening hole 25*a*. On the other hand, the second chamber 26 is connected to a negative pressure source capable of decreasing the pressure inside the second chamber 26 through a pressure adjusting passage 29. The pressure adjusting passage 29 is provided with a valve 30 which is able to open and close the pressure adjusting passage 29. Further, the second chamber 26 is provided with a compression spring 31 which presses the partition member 27 toward the diffuser portion side (the left side in the figure) so that the movable vane 21 moves to the housing position P2.

According to the actuator 22, when the valve 30 is opened so as to decrease the pressure of the second chamber 26, a pressure difference occurs between the first chamber 25 and the second chamber 26. The pressure difference moves the partition member 27 toward the anti-diffuser portion side against the compression spring 31. Accordingly, the movable vane 21 moves to the projecting position. On the other hand, when the valve 30 is closed, the pressure of the second chamber 26 increases, so that the pressure difference between the first chamber 25 and the second chamber 26 decreases, and hence the partition member 27 moves toward the diffuser portion side by the compression spring 31. Thereby, the movable vane 21 moves to the housing position. By controlling the pressure difference between the first chamber 25 and the second chamber 26 in this way, the valve 30 functions as a pressure control device of the present invention.

According to the compressor 10A of the first embodiment, since the housing portion 23 which houses the movable vane 21 is provided in the compressor housing 18 and the actuator 22 is provided in the center housing 17, it is possible to prevent only one side of the diffuser portion 16 from being lengthened in the direction of the axis Ax. Further, since the volume of the housing portion 23 may be slightly larger than the volume of the movable vane 21, it is possible to prevent increasing in size of the housing portion 23 too much without any purpose. Furthermore, it is possible to decrease the volume of the operation chamber 24 compared to the case where the movable vane 21 is housed in the operation chamber 24. Accordingly, since it is possible to suppress increasing in size of the housing 11, it is possible to downsize of the compressor 10A.

Further, in the compressor 10A, since it is unnecessary to house the movable vane 21 in the operation chamber 24, the cross-sectional area of the penetration hole 17*a* provided in the center housing 17 can be decreased. In the internal combustion engine, a part of exhaust gas is recirculated to the intake passage and a blow-by gas is led into the intake passage. As well known, the exhaust gas contains particle matter, and the blow-by gas contains oil. For this reason, the particle matter and the oil flow into the compressor 10A. In the compressor 10A, since it is possible to decrease the cross-sectional area of the penetration hole 17*a*, it is possible to sufficiently suppress the particle matter and the oil from entering an operation chamber 24 through a gap between the penetration hole 17*a* and the connection member 28. For this reason, it is possible to suppress the compression spring 32 from being degraded and the partition member 27 from being fixed by the particle matter and the oil thereon.

Second Embodiment

A compressor 10B according to a second embodiment of the present invention will be described with reference to FIG.

4. In this figure, a part of the cross-section of the compressor 10B is shown. Further, in this embodiment, the same components as those in the first embodiment are denoted by the same reference numeral, and descriptions thereof will be omitted. As shown in this figure, in the second embodiment, an operation hole 41 which serves as the operation chamber 24 is provided in the center housing 17. The operation hole 41 is provided so as to be opened to the diffuser portion 16. A bushing 42 which serves as a partition wall member is attached to the operation hole 41 so as to close an opening portion of the hole 41, so that the operation chamber 24 is formed. As shown in this figure, the bushing 42 is attached to the center housing 17 so that any uneven portion is not formed in the wall surface forming the diffuser portion 16. In this way, the bushing 42 is arranged between the diffuser portion 16 and the operation chamber 24 to separate the diffuser portion 16 and the operation chamber 24 from each other. As shown in this figure, the penetration hole 17*a* is provided in the bushing 42.

According to the compressor 10B of the second embodiment, the operation chamber 24 can be opened by separating each of the compressor housing 18 and the bushing 42. Thereby, components such as the partition member and the compression spring can be easily inserted into the operation chamber 24. Accordingly, the compressor 10B can be easily assembled, and the working efficiency can be improved.

Third Embodiment

Figure 5:
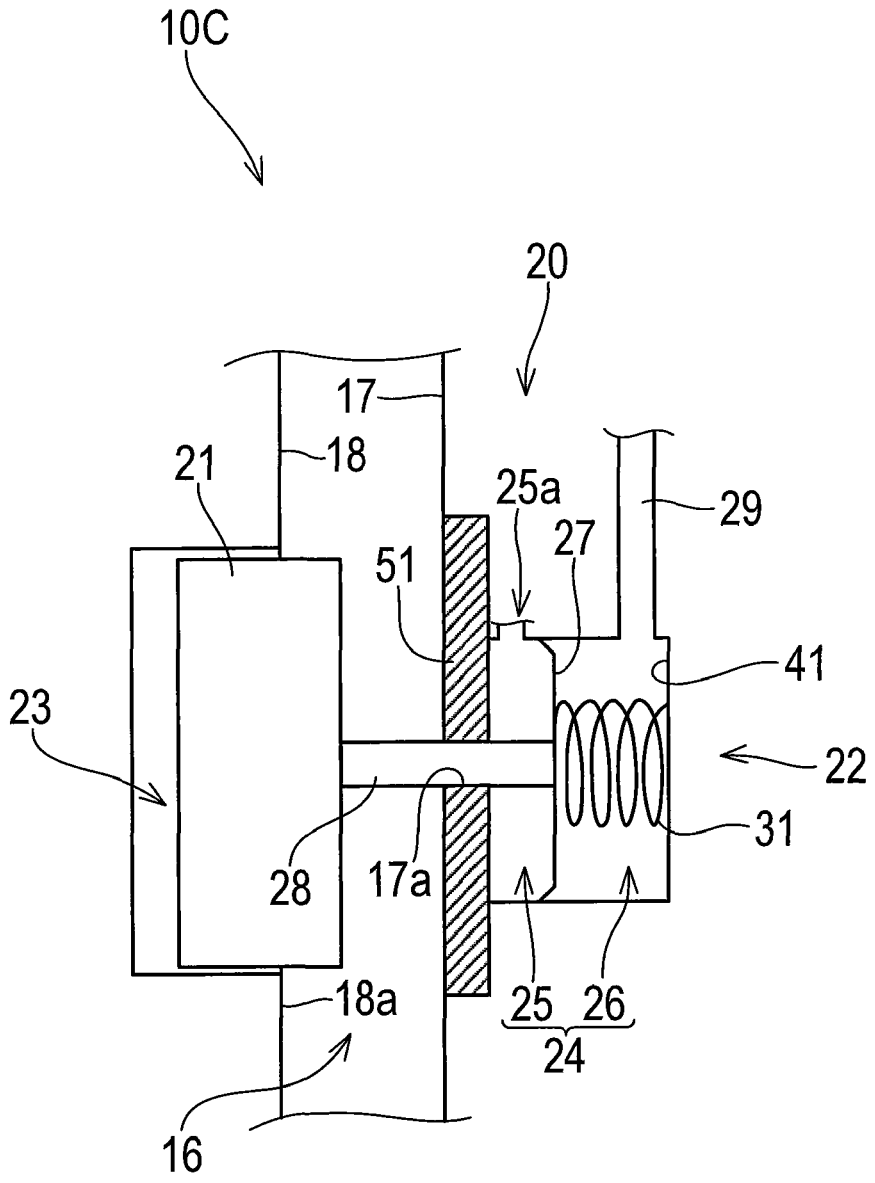
FIG. 5 is a view showing a centrifugal compressor according to a third embodiment of the present invention.

A compressor 10C according to a third embodiment of the present invention will be described with reference to FIG. 5. In this figure, a part of the cross-section of the compressor 10C is shown. Further, in this embodiment, the same components as those in the above-described embodiment are denoted by the same reference numeral, and descriptions thereof will be omitted. As shown in this figure, in the third embodiment, there is a difference in that the operation chamber 24 is formed by closing the operation hole 41 using a bushing 51 which is larger than the movable vane 21. Further, in this embodiment, the movable vane 21 comes into contact with the center housing 17 at the projecting position P1. The bushing 51 is formed of an elastic material such as rubber. Further, the bushing 51 is provided such that the entire end surface of the movable vane 21 on the side of the center housing 17 comes into contact with the bushing 51 when the movable vane 21 moves to the projecting position P1.

According to the compressor 10C of the third embodiment, it is possible to prevent abnormal noise from being generated even when the movable vane 21 and the bushing 51 come into contact with each other. Further, it is possible to prevent the movable vane 21 from being abraded and broken even when the movable vane 21 and the bushing 51 come into contact with each other. In this embodiment, since the movable vane 21 comes into contact with the bushing 51 at the projecting position P1, there is no gap between the movable vane 21 and the bushing 51. In this case, since a gas which is ejected from the compressor wheel 13 can be reliably guided between the movable vanes, it is possible to improve the efficiency of the compressor 10C when the movable vane 21 moves to the projecting position P1. Further, when the movable vane 21 and the center housing 17 come into contact with each other at the projecting position P1 in this way, it is possible to prevent a variation in the position of the movable vane 21 at the projecting position P1 for each product. Thereby, it is possible to suppress a variation in the performance for each product.

Fourth Embodiment

Figure 6:
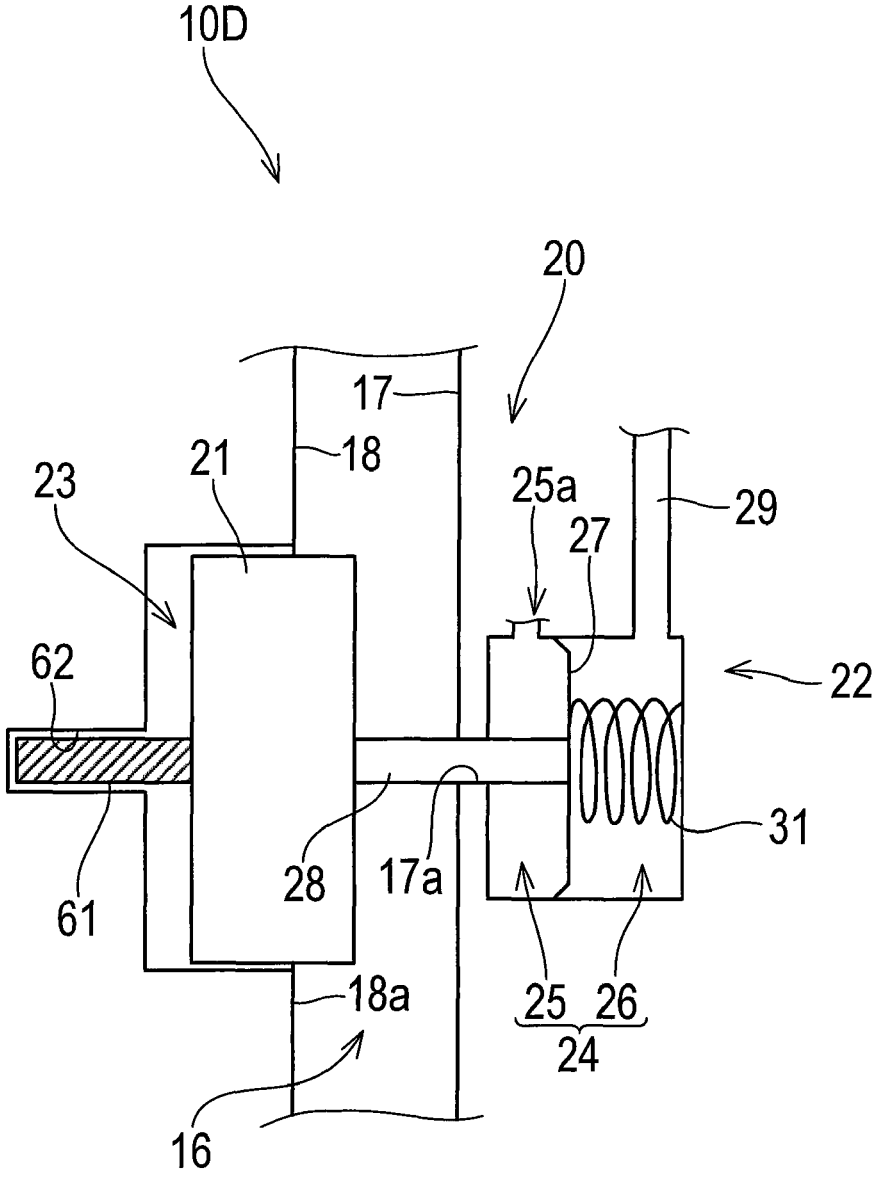
FIG. 6 is a view showing a centrifugal compressor according to a fourth embodiment of the present invention.

A compressor 10D according to a fourth embodiment of the present invention will be described with reference to FIG. 6. In this figure, a part of the cross-section of the compressor 10D is shown. Further, in this embodiment, the same components as those in the above-described embodiment are denoted by the same reference numeral, and descriptions thereof will be omitted. As shown in this figure, in the fourth embodiment, a support shaft 61 as a shaft member which extends from the movable vane 21 toward the side of the compressor housing 18 is provided. The support shaft 61 is provided on the movable vane 21 so as to be coaxial with the connection member 28. The compressor housing 18 is provided with a support hole 62 which supports the support shaft 61 in a slidable manner. In this embodiment, the movable vane 21 is supported by both housings of the center housing 17 and the compressor housing 18. That is, the movable vane 21 is supported at both sides thereof respectively.

According to this embodiment, since the movable vane is supported by both housings 17 and 18, it is possible to reduce a friction between the connection member 28 and the center housing 17. For this reason, it is possible to reduce a driving force which is necessary for driving the movable vane 21 from the housing position P2 to the projecting position P1. Thus, it is possible to downsizing the actuator 22. Then, it is possible to downsizing the compressor 10D further. Further, by reducing the friction in this way, the abrasion of the connection member 28 and the center housing 17 can be suppressed.

Fifth Embodiment

Figure 7:
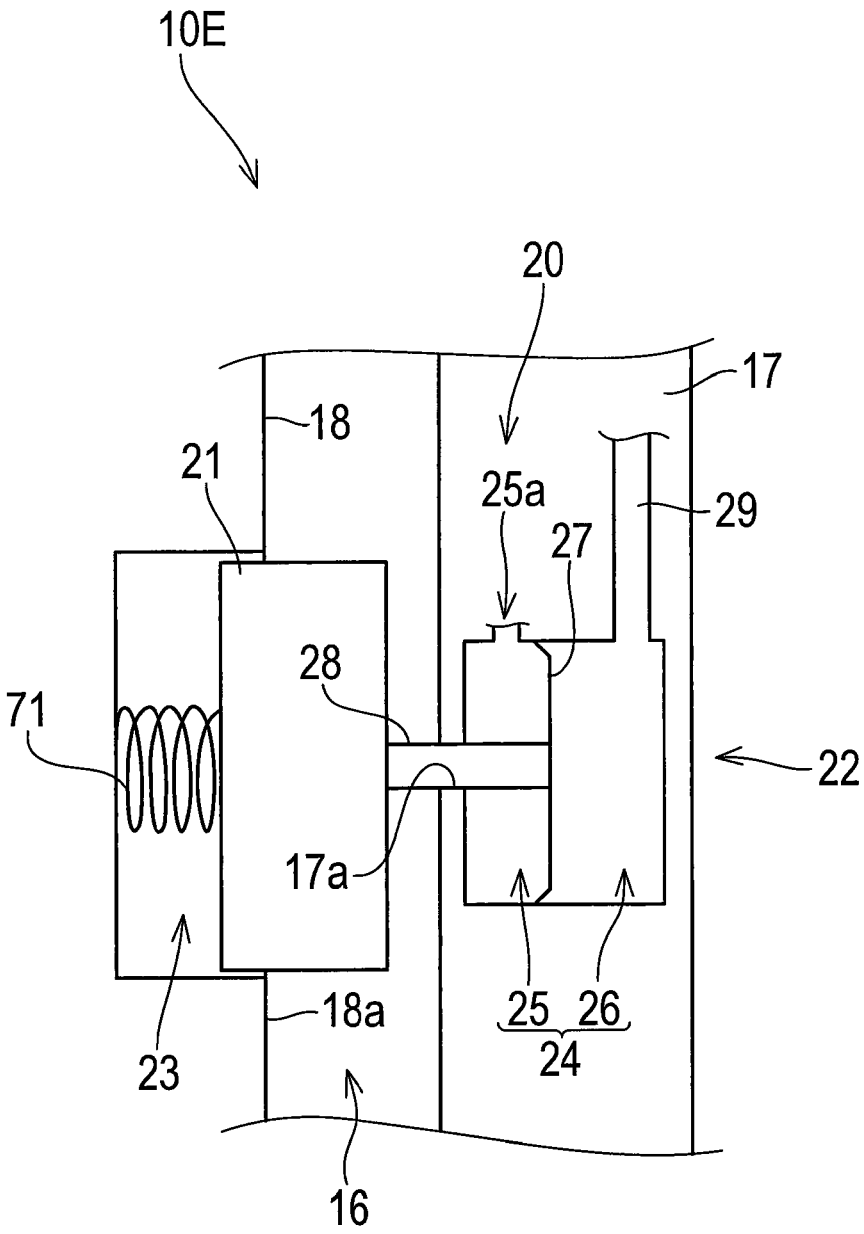
FIG. 7 is a view showing a centrifugal compressor according to a fifth embodiment of the present invention.

A compressor 10E according to a fifth embodiment of the present invention will be described with reference to FIG. 7. In this figure, a part of the cross-section of the compressor 10E is shown. Further, in this embodiment, the same components as those in the above-described embodiment are denoted by the same reference numeral, and descriptions thereof will be omitted. As shown in this figure, in the fifth embodiment, there is a difference compared to the above-described embodiments in that a compression spring 71 is provided inside the housing portion 23 instead of the compression spring 31 of the second chamber 26. The compression spring 71 presses the movable vane 21 toward the side of the center housing 17 so that the movable vane 21 moves from the housing position P2 to the projecting position P1. Further, in this embodiment, the second chamber 26 of the actuator 22 is connected to a pressurization source capable of increasing the pressure inside the second chamber 26 so as to be higher than the atmospheric pressure via the pressure adjusting passage 29. Then, in this embodiment, when the valve 30 is opened and the pressure of the second chamber 26 becomes higher than the atmospheric pressure, the partition member 27 moves to the diffuser portion side due to a pressure difference between the first chamber 25 and the second chamber 26. Then, the movable vane 21 moves to the housing position P2. On the other hand, when the valve 30 is closed, since the pressure difference between the first chamber 25 and the second chamber 26 becomes smaller, the movable vane 21 is moved to the projecting position P1 by the compression spring 71.

In the fifth embodiment, since the compression spring 71 is provided in the compressor housing 18, the operation chamber 24 can be further decreased in size. Thereby, it is possible to downsizing the compressor 10E further.

The present invention is not limited to the above-described embodiments, and may be executed in various modes. For example, the above described embodiments may be combined with each other, as long as they do not bother each other. For example, the third embodiment and the fourth embodiment may be combined with each other, and the third embodiment, the fourth embodiment, and the fifth embodiment may be combined with each other.

In the above-described embodiments, the center housing is provided with the actuator and the compressor housing is provided with the housing portion. However, the arrangement of the actuator and the housing portion may be reversed. That is, the center housing may be provided with the housing portion and the compressor housing may be provided with the actuator. Further, in the above-described embodiments, the plural movable vanes are driven by the common actuator, but the actuator may be provided for each movable vane.

Figure 8:
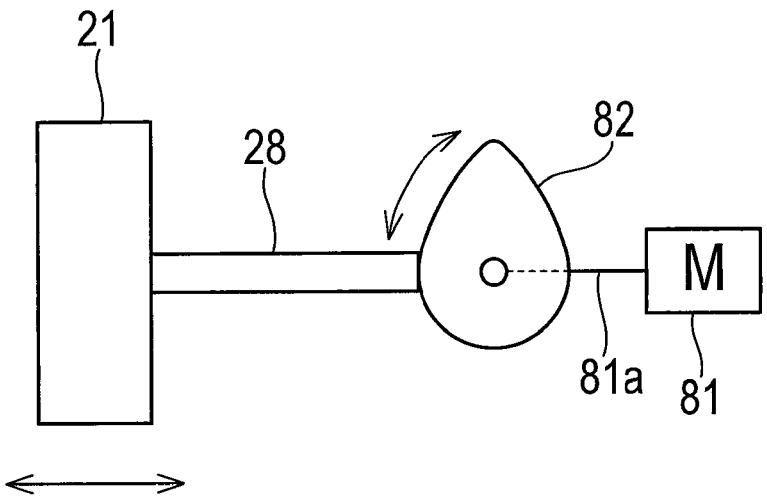
FIG. 8 is a view showing another example of an actuator which is provided in the centrifugal compressor of the present invention.
Figure 9:
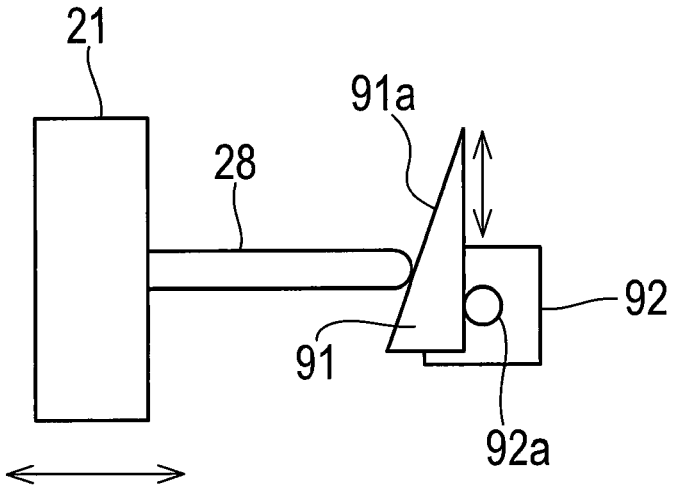
FIG. 9 is a view showing still another example of the actuator which is provided in the centrifugal compressor of the present invention.

The driving device which drives the movable vane is not limited to a driving device which generates a driving force using a pressure difference, and various driving apparatuses capable of moving the movable vane in a reciprocating manner may be used. For example, the movable vane may be driven by using an electric motor. In this case, for example, as shown in FIG. 8, a cam 82 is provided on an output shaft 81*a* of an electric motor 81. Then, by switching the position of the cam 82 using the electric motor 81, the movable vane 21 may be driven. Further, as shown in FIG. 9, a wedge-like position switching member 91 which has an inclined surface 91*a* extending in a direction inclined with respect to the movement direction of the movable vane 21 is provided, and the position switching member 91 is moved in the up-down direction of the drawing so as to drive the movable vane 21. A portion of the connection member 28 which comes into contact with the position switching member 91 may be rounded. In this case, an output shaft of an electric motor 92 is provided with a gear 92*a*, and the position switching member 91 is driven by the gear 92*a*. The electric motor 81 and the cam 82 in the driving apparatus of FIG. 8 and the position switching member 91 and the electric motor 92 in the driving apparatus of FIG. 9 respectively correspond to the driving device of the present invention. Further, in the driving apparatus of FIG. 9, the connection member 28 corresponds to the transmitting member of the present invention. The movable vane and the movable vane driving mechanism of the present invention may be provided on the turbine of the turbocharger.

The invention claimed is:

1. A centrifugal compressor comprising:

a housing which houses a compressor wheel therein and supports the compressor wheel so as to be rotatable about an axis;

a spiral scroll which is provided in the housing so as to be arranged in an outer periphery of the compressor wheel; and a diffuser portion which is provided as a path space communicating with the scroll from an outlet side of the compressor wheel and is formed by a pair of wall portions facing each other, wherein the centrifugal compressor further comprises:

a movable vane which is movable between a projecting position where the movable vane projects so as to cross the diffuser portion from a first wall portion of the pair of wall portions and a housing position where the movable vane retracts toward the first wall portion from the projecting position so as to be housed in a housing portion provided in the first wall portion; and a driving device which drives the movable vane between the projecting position and the housing position, wherein the driving device includes an operation chamber which is provided in wall a second wall portion of the pair of wall portions, a partition member which is movable inside the operation chamber in a reciprocating manner so as to divide the inside of the operation chamber into a first chamber provided on a diffuser portion side and a second chamber provided on an anti-diffuser portion side opposite side of the diffuser portion side, a connection member which connects the partition member and the movable vane to each other so as to be operated as one unit through a penetration hole provided in the second wall portion, a spring device which presses at least either one of the movable vane and the partition member toward either a first side of the diffuser portion side or the anti-diffuser portion side so that the partition member moves toward the first side, and a pressure control device which is capable of controlling a difference between a pressure of the first chamber and a pressure of the second chamber so that the partition member moves toward the other side of the diffuser portion side or the anti-diffuser portion side against the spring device, wherein the movable vane is provided with a shaft member which extends from the movable vane toward the first wall portion so as to be parallel to a movement direction of the movable vane, the one wall first wall portion is provided with a support hole which supports the shaft member in a slidable manner, and the movable vane is supported at both sides thereof by the pair of wall portions respectively due to the connection member supported by the second wall portion and the shaft member supported by the first wall portion.

2. The centrifugal compressor according to claim 1, wherein the second wall portion is provided with a partition wall member which includes the penetration hole and is arranged between the diffuser portion and the operation chamber so as to separate the operation chamber and the diffuser portion from each other.

3. The centrifugal compressor according to claim 2, wherein the movable vane comes into contact with the partition wall member at the projecting position, and at least a portion in the partition wall member which comes into contact with the movable vane is formed of an elastic material.

4. The centrifugal compressor according to claim 1, wherein the spring device is provided in the first wall portion.

5. A turbocharger comprising:

the centrifugal compressor according to claim 1 and a turbine, wherein the centrifugal compressor is provided to an intake passage of an internal combustion engine and the turbine is provided to an exhaust passage of the internal combustion engine, and the turbine recovers exhaust energy of the internal combustion engine, and the turbocharger supercharges the internal combustion engine by driving to rotate the compressor wheel of the centrifugal compressor by the exhaust energy recovered.

* * * * *

UNITED STATES PATENT AND TRADEMARK OFFICE

CERTIFICATE OF CORRECTION

PATENT NO. : 8,689,552 B2
APPLICATION NO. : 13/508085
DATED : April 8, 2014
INVENTOR(S) : A. Iwata It is certified that error appears in the above-identified patent and that said Letters Patent is hereby corrected as shown below:

In the Claims:

At column 10, line 3, change "is provided in wall a second" to -- is provided in a second --.

At column 10, line 31, change "the one wall first wall" to -- the first wall --.

Signed and Sealed this
Thirtieth Day of September, 2014

Michelle K. Lee

Michelle K. Lee
*Deputy Director of the United States Patent and Trademark Office*